US006793111B2

(12) United States Patent
Chang

(10) Patent No.: US 6,793,111 B2
(45) Date of Patent: Sep. 21, 2004

(54) OUTER ASSEMBLING MECHANISM OF BACKPACK FOR CARRYING DETACHABLE SKATE

(76) Inventor: Chun-Cheng Chang, No. 492-16, Chia-Li Hsing, Chia-Li Chen, Tainan Hsien (TW)

( * ) Notice: Subject to any disclaimer, the term of this patent is extended or adjusted under 35 U.S.C. 154(b) by 49 days.

(21) Appl. No.: 10/230,180

(22) Filed: Aug. 29, 2002

(65) Prior Publication Data

US 2004/0040996 A1 Mar. 4, 2004

(51) Int. Cl.[7] ..... A45C 15/00

(52) U.S. Cl. ..... 224/576; 224/650; 224/242; 280/7.13; 280/11.3

(58) Field of Search ..... 224/576, 153, 224/650, 680, 242, 249; 280/7.13, 11.3

(56) References Cited

U.S. PATENT DOCUMENTS 4,126,256 A * 11/1978 McGruder ..... 206/294
5,456,353 A * 10/1995 Challoner et al. ..... 206/292
D369,021 S * 4/1996 Kliot ..... D3/217
5,628,443 A * 5/1997 Deutsch ..... 224/583
D380,294 S * 7/1997 Kliot ..... D3/217
5,651,486 A * 7/1997 Kliot ..... 224/653
5,826,771 A * 10/1998 Peng ..... 224/651
5,881,708 A * 3/1999 Kliot ..... 224/653
6,145,721 A * 11/2000 Gately ..... 224/680
2003/0155724 A1 * 8/2003 Wang et al. ..... 280/11.3

* cited by examiner

*Primary Examiner*—Stephen K. Cronin
(74) *Attorney, Agent, or Firm*—Bacon & Thomas, PLLC

(57) ABSTRACT

An outer assembling mechanism of a backpack for carrying a detachable skate. The mechanism includes a base plate fixed to assembling seats. The assembling seats are adapted to releasably engage with the detachable skate for walking or to disengage with the detachable skate for skating.

10 Claims, 6 Drawing Sheets

OUTER ASSEMBLING MECHANISM OF BACKPACK FOR CARRYING DETACHABLE SKATE

BACKGROUND OF THE INVENTION

1. Field of the Invention

The present invention is related to an outer assembling mechanism of a backpack for carrying a detachable skate and more particularly to the backpack provides with the outer assembling mechanism which is adapted to conveniently assemble or disassemble the detachable ice/roller skate.

2. Description of the Related Art

The technology trend in skates manufacturing has been toward convertible shoe with a detachable roller skate. Attaching the detachable roller skate to the convertible shoe capable of converting from a shoe into a roller skate at will is known in the art. Also, detaching the detachable roller skate from the convertible shoe capable of converting a roller skate into a shoe for walking is known in the art. Thus, a skater can avoid carrying additional footwear for walking or other physical activity when the skates are not in use or are not allowed.

U.S. Pat. No. 2,998,260, issued on Aug. 29, 1961 to Meyer, discloses a skate shoe and interchangeable roller and ice skates therefor. The skate shoe includes the combination of mounting plate secured beneath the sole of the shoe. This mounting plate is provided with a plurality of headed studs and a lug. A skate has a top plate matching the mounting plate having a plurality of keyhole slots and a locking slot. The keyhole slots are capable of receiving the headed studs when the shoe is placed upon the skate for retaining the shoe assembled with the skate. The lug is capable of inserting into the locking slot so that a screw mount lug and a locking screw thereof is adjusted to abut against the lug to effectively lock the shoe in place upon the top plate of the skate. However, U.S. Pat. No. 2,998,260 fails to provide with an assembling mechanism for the skate in storage after detached from the skate shoe.

U.S. Pat. No. 6,120,038, issued on Sep. 19, 2000 to Dong et al., discloses a skate having a shoe portion detachably secured to a plurality of longitudinally aligned skate wheels for traversing a surface. The shoe portion having a sole defining a toe end and a heel end. The skate further includes a frame having an upper surface and a lower surface attached to the wheels. The skate also includes a heel latch member rotatably attached to the frame for receiving and coupling to a heel binding attachment surface located in the heel end of the sole to the frame. A lever arm is attached to the heel latch member to selectively release or attach the shoe portion from the heel latch member. The heel latch member is rotatable about a vertical axis extending normal to the elongate direction of the frame. The heel latch member is rotatable between a locked position, wherein the heel attachment member is nested therein, and an open position, wherein the frame is detachable from the shoe portion to convert the skate into a convention shoe. However, U.S. Pat. No. 6,120,038, like U.S. Pat. No. 2,998,260, fails to provide with an assembling mechanism for the skate in storage after detached from the skate shoe.

Referring to FIG. 1, U.S. patent application Ser. No. 10/142,782 discloses a sport shoe 1 and a detachable skate 40 attached thereto by a locking device 20 and a pivotal device 30. However, a skater must store the skate 40 in a backpack after detached from the sport shoe 1. Accordingly, a need exists for improved assembly of the skate 40 on a backpack.

The present invention intends to provide a backpack with an outer assembling mechanism for carrying a detachable skate in such a way to mitigate and overcome the above problem.

SUMMARY OF THE INVENTION

The primary objective of this invention is to provide an outer assembling mechanism of a backpack for carrying a detachable skate, which allows conveniently assembling the detachable skate in walking or disassembling the detachable skate for skating.

The secondary objective of this invention is to provide the outer assembling mechanism of the backpack for carrying the detachable skate, particularly avoiding inner assembled relationship of the backpack with the skate and thus increasing useful inner space of the backpack.

The outer assembling mechanism of the backpack for carrying the detachable skate in accordance with the present invention mainly comprises a base plate and a plurality of assembling seats fixed thereto. The assembling seats are adapted to releasably engage with the detachable skate in walking or to disengage with the detachable skate for skating.

Another aspect of the present invention is the base plate arranged at a bottom of the backpack.

Another aspect of the present invention is the base plate providing with a plurality of cavities adapted to receive the assembling seats.

Another aspect of the present invention is the assembling seats comprised of a locking seat and a pivotal seat adapted to correspondingly engage with a locking device and a pivotal device of the detachable skate.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
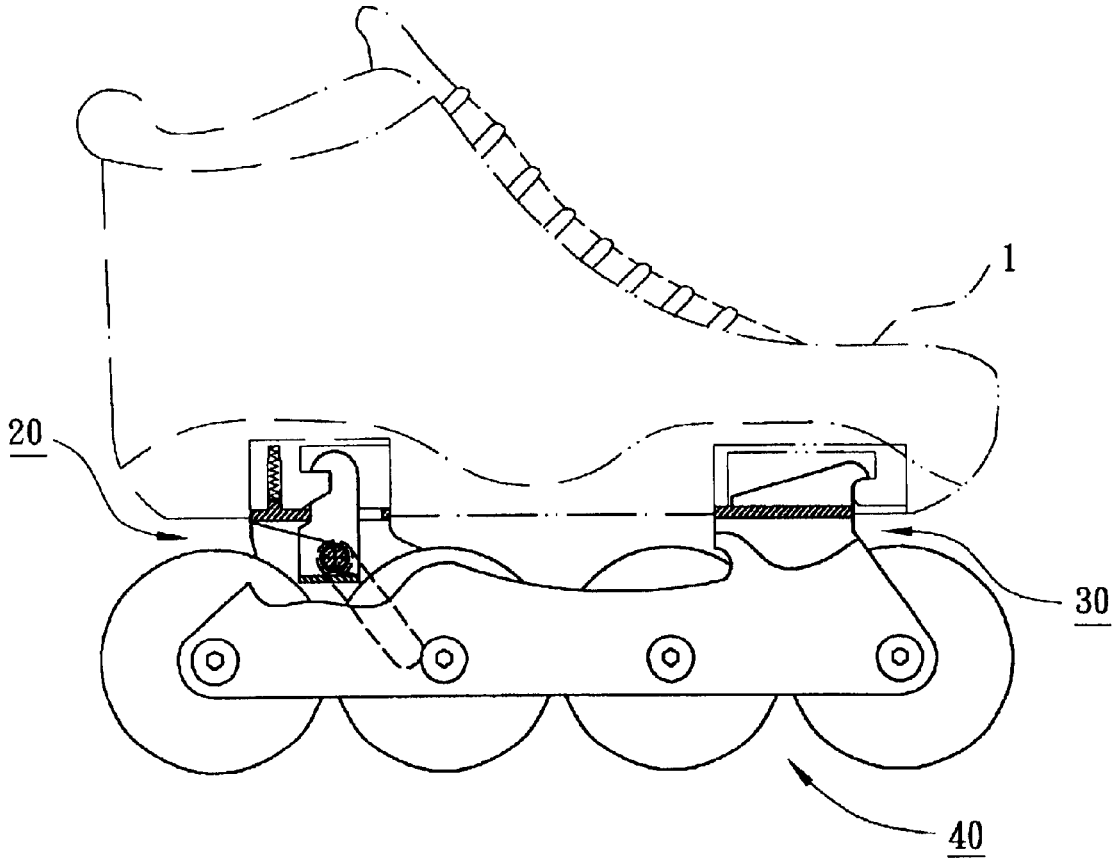
FIG. 1 PRIOR ART
FIG. 1 is a lateral view of the detachable skate of sports shoe in accordance with U.S. patent application Ser. No. 10/142,782.

Referring now to the drawings, there are two embodiments of the present invention shown therein, which include generally a primary backpack member and a secondary skate member.

Referring to FIGS. 2 through 5, reference numerals of a first embodiment of the present invention have applied the identical numerals of conventional skate, as shown in FIG. 1.

Figure 2:
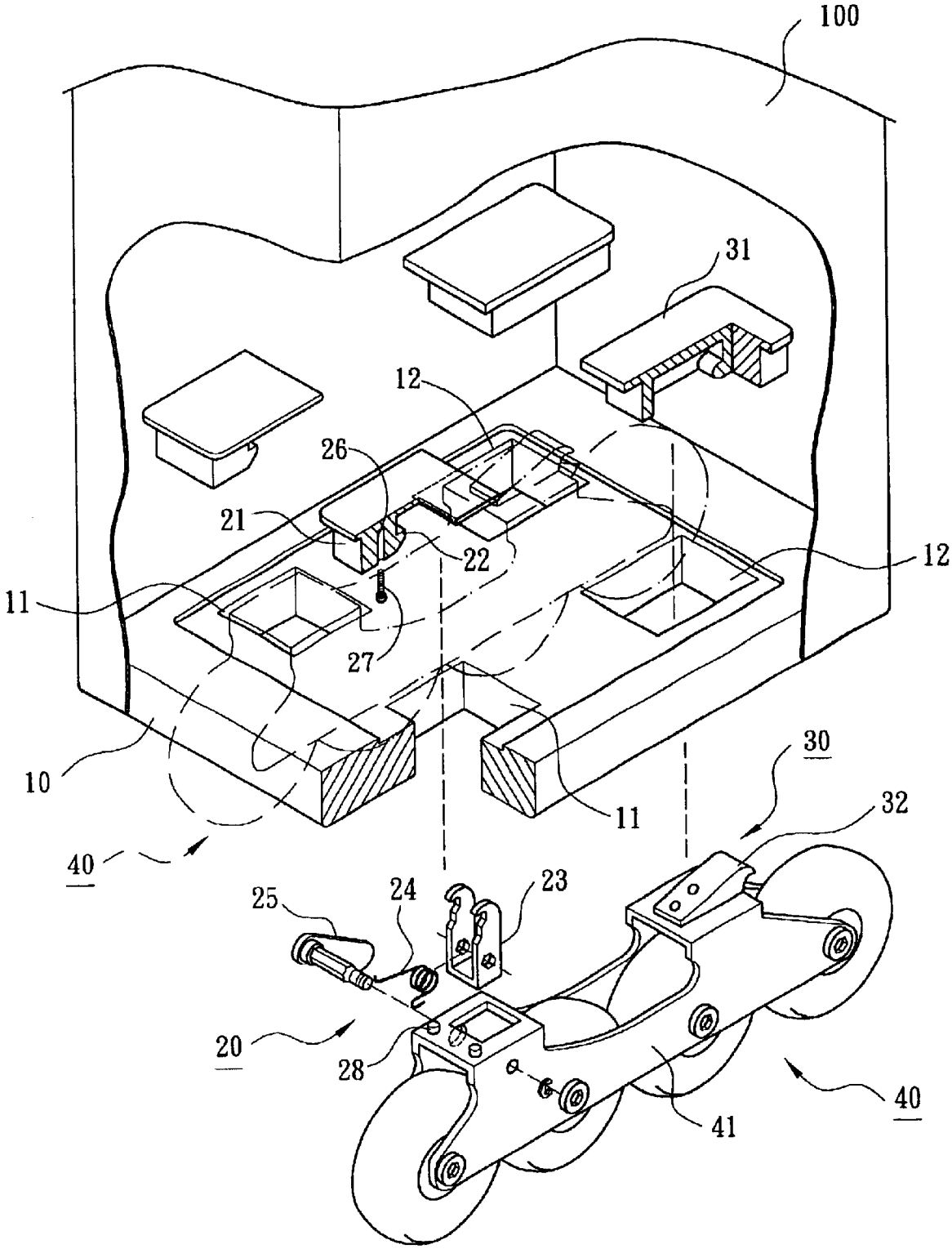
FIG. 2 is an exploded perspective view of an outer assembling mechanism of a backpack for carrying a detachable skate in accordance with a first embodiment of the present invention.
Figure 3:
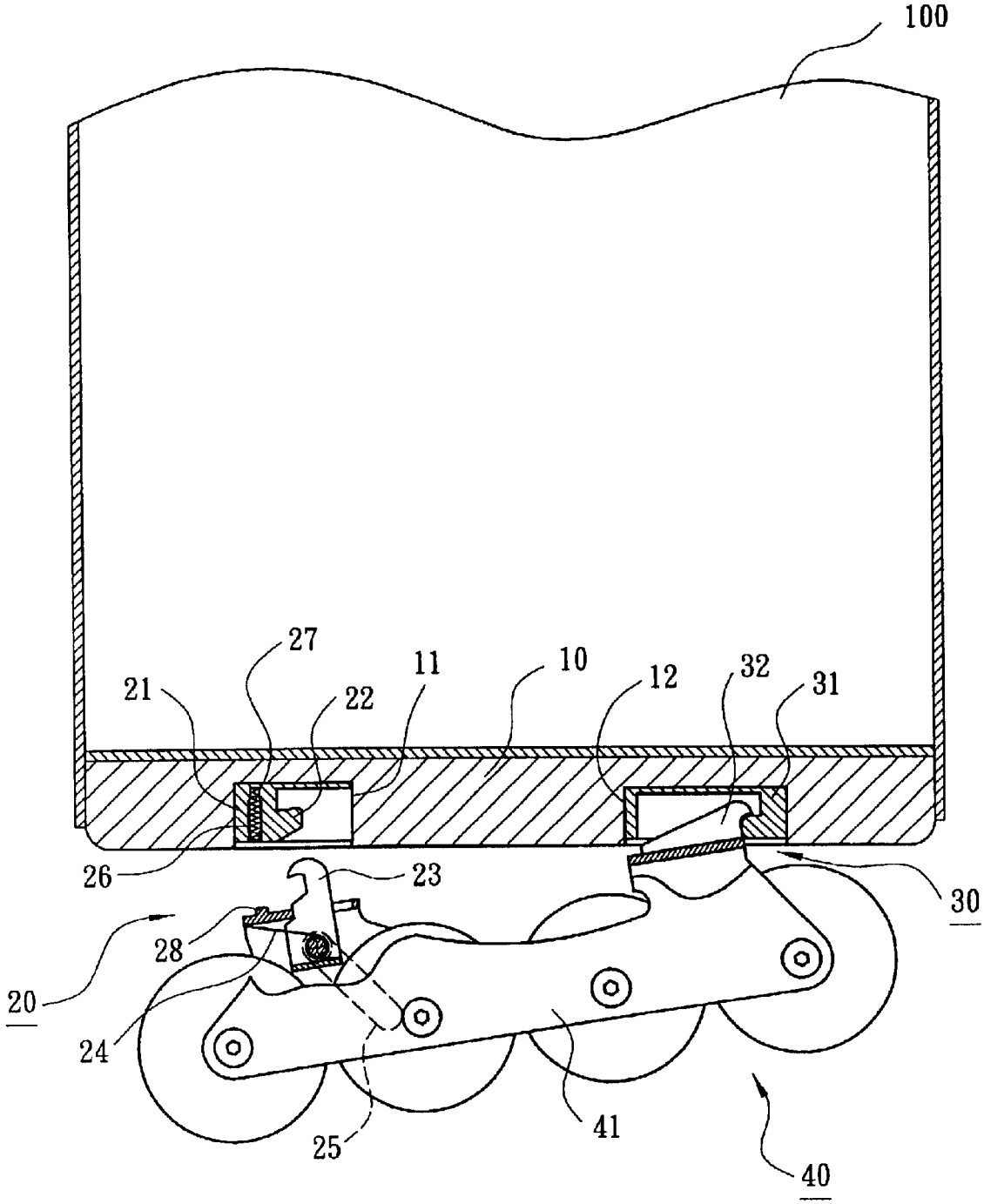
FIG. 3 is a partial cross-sectional view of the outer assembling mechanism of the backpack in accordance with the first embodiment of the present invention, initially assembling the detachable skate.

Referring initially to FIGS. 2 and 3, a backpack 100 in accordance with the first embodiment of the present invention generally includes a base plate designated as numeral 10, a locking device designated as numeral 20, a pivotal device designated as numeral 30, and a detachable skate 40. Much of the detailed construction of the backpack 100 is omitted.

Referring again to FIGS. 2 and 3, the base plate 10 is arranged at a bottom of the backpack 100. The base plate 10 comprises two first cavities 11 and two second cavities 12 at its underside each having an appropriate opening so as to contain the two locking device 20 and the two pivotal device 30 respectively. Preferably, pair of the detachable skates 40 are arranged longitudinal and symmetrical with respect to the base plate 10, as best shown in FIG. 2. In addition, the detachable skate 40 is preferable an in-line roller skate and constructs a locking member of the locking device 20 and a pivotal member of the pivotal device 30 on an uppermost portion of a main frame 41. The main frame 41 essentially comprises a toe end and heel end.

Construction of the locking device 20 shall be described in detail, referring again to FIGS. 2 and 3. The locking device 20 includes a locking seat 21, a rotatable hook 23, an elastic member 24 and a lever 25. The locking seat 21 is adapted to form an assembling seat and securely fixed to the base plate 10 in the first cavity 11. The locking seat 21 comprises an engaging wall 22 formed with a protrusion. The rotatable hook 23 is projected upward from the heel end of the skate 40 being adapted to releasably engage with the engaging wall 22 of the locking seat 21 in the first cavity 11. The elastic member 24 is provided to bias the rotatable hook 23 and the lever 25 is used to rotate the rotatable hook 23 for disassembling by means of overcoming bias force of the elastic member 24. In addition, the locking seat 21 further comprises a pair of guiding holes 26 and elastic members 27 received therein. The heel end of the skate 40 further comprises a pair of guiding studs 28 being adapted to insert into the guiding holes 26 and thus biased by the elastic members 27.

The pivotal device 30 in accordance with the present invention allows pivotal movement of the detachable skate 40 with respect to the base plate 10 during assembling or disassembling operation. Construction of the pivotal device 30 shall be described in detail, referring again to FIGS. 2 and 3. The pivotal device 30 includes a pivotal seat 31 and a pivotal hook 32. The pivotal seat 31 is adapted to form an assembling seat and securely fixed to the base plate 10 in the second cavity 12. The pivotal hook 32 is projected upward from the toe end of the detachable skate 40 being adapted to releasably engage with the pivotal seat 31 in the second cavity 12 while initially assembling.

Figure 4:
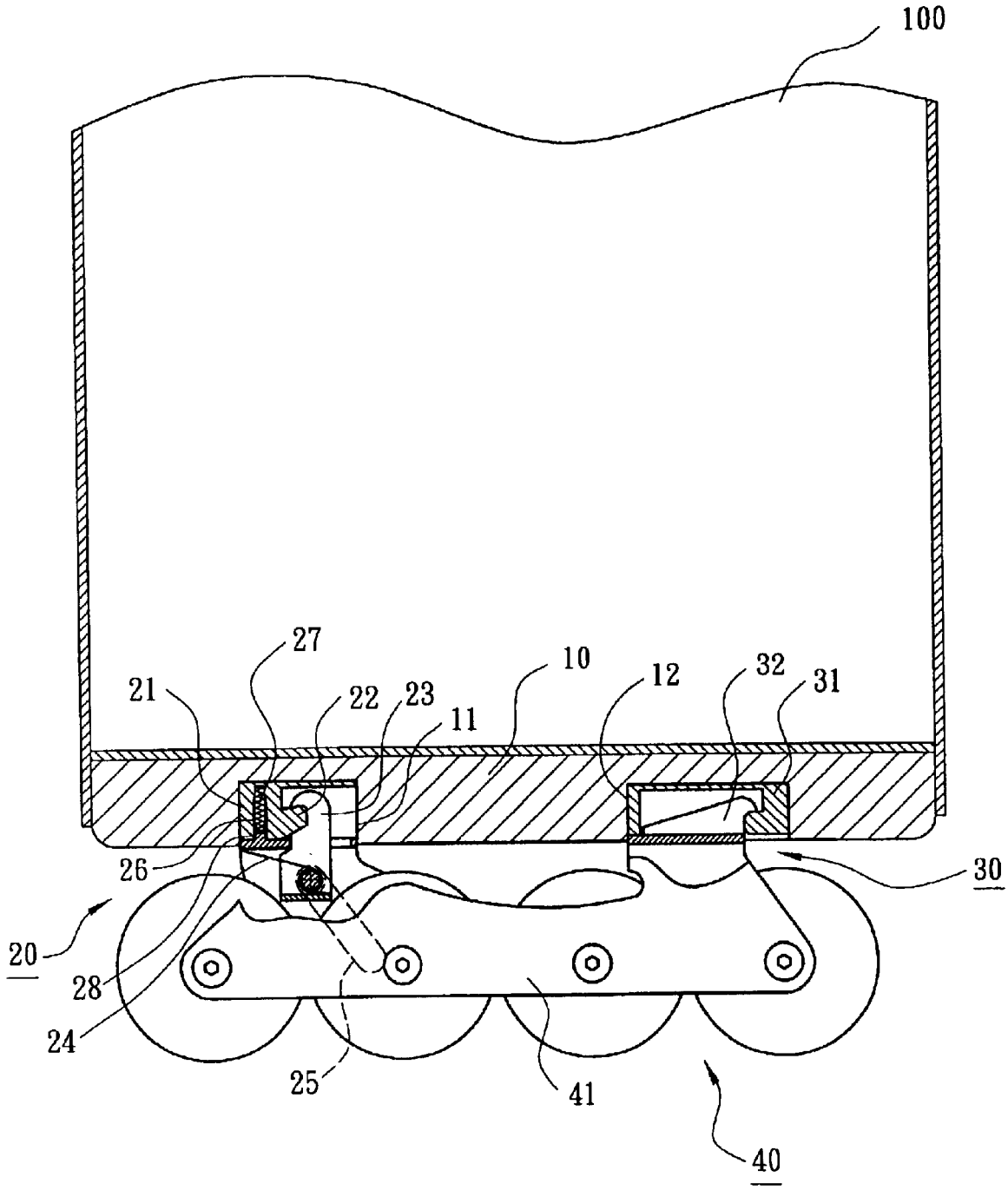
FIG. 4 is a partial cross-sectional view of the outer assembling mechanism of the backpack in accordance with the first embodiment of the present invention combined with the detachable skate.

The detachable skate 40 is detached from the sport shoe 1, as shown in FIG. 1, on purpose of walking. Assembling operation of the detachable skate 40 with the base plate 10 shall be described in three steps, referring now to FIGS. 3 and 4. In first step, the pivotal hook 32 is inserted into the pivotal seat 31, as best shown in FIG. 3. In second step, the detachable skate 40 is rotated a predetermined angle with respect to the pivotal device 30 and the guiding studs 28 is initially inserted into the guiding holes 26. In third step, the guiding stud 28 is completely inserted into the guiding hole 26 and then the rotatable hook 23 is completely engaged with the engaging wall 22, as best shown in FIG. 4.

Locked situation of the locking device shall now be described with reference back to FIG. 3. In locked position, the pivotal hook 32 is engaged with the pivotal seat 31 of the base plate 10 while the rotatable hook 23 is engaged with the locking seat 21. The lever 25 is capable of actuating to unlock the locking device 20 for detaching the detachable skate 40 from the base plate 10 so as to prepare the detachable skate 40 combing with the sport shoe 1, as best shown in FIG. 1.

Figure 5:
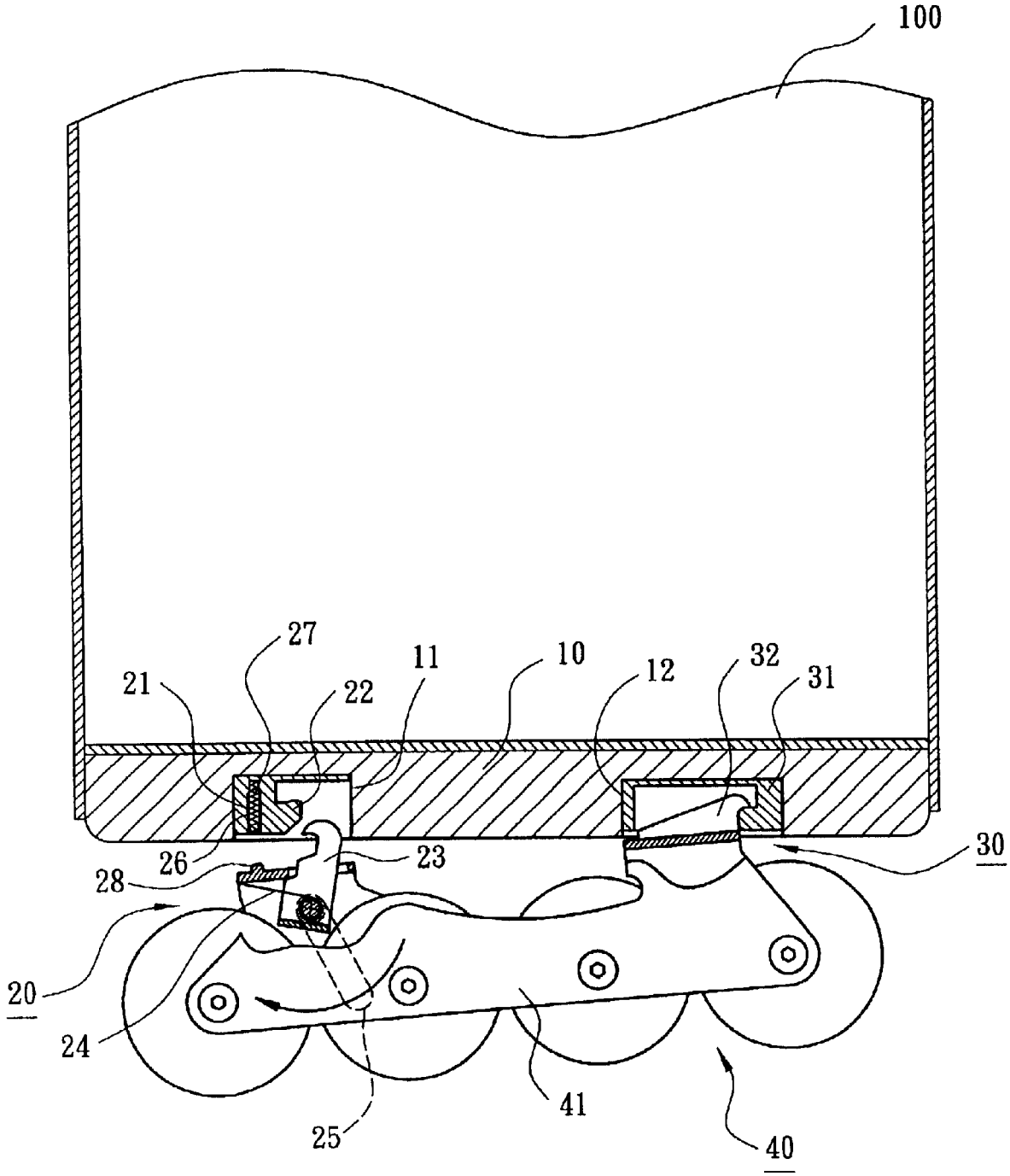
FIG. 5 is a partial cross-sectional view of the outer assembling mechanism of the backpack in accordance with the first embodiment of the present invention, disassembling the detachable skate.

Releasing operation of the locking device 20 shall now be described with reference now to FIG. 5. In releasing operation, the lever 25 is rotated a predetermined angle in clockwise direction to thereby disengage the rotatable hook 23 with the engaging wall 22. As the rotatable hook 23 rotates a predetermined angular distance round its axis, it is disengaged with the engaging wall 22. In released situation, the heel end of the detachable skate 40 is automatically released from the base plate 10 by means of bias force of the elastic member 27. The rotatable hook 23 is returned to the original position by means of bias force of the elastic member 25 while releasing the lever 25.

Figure 6:
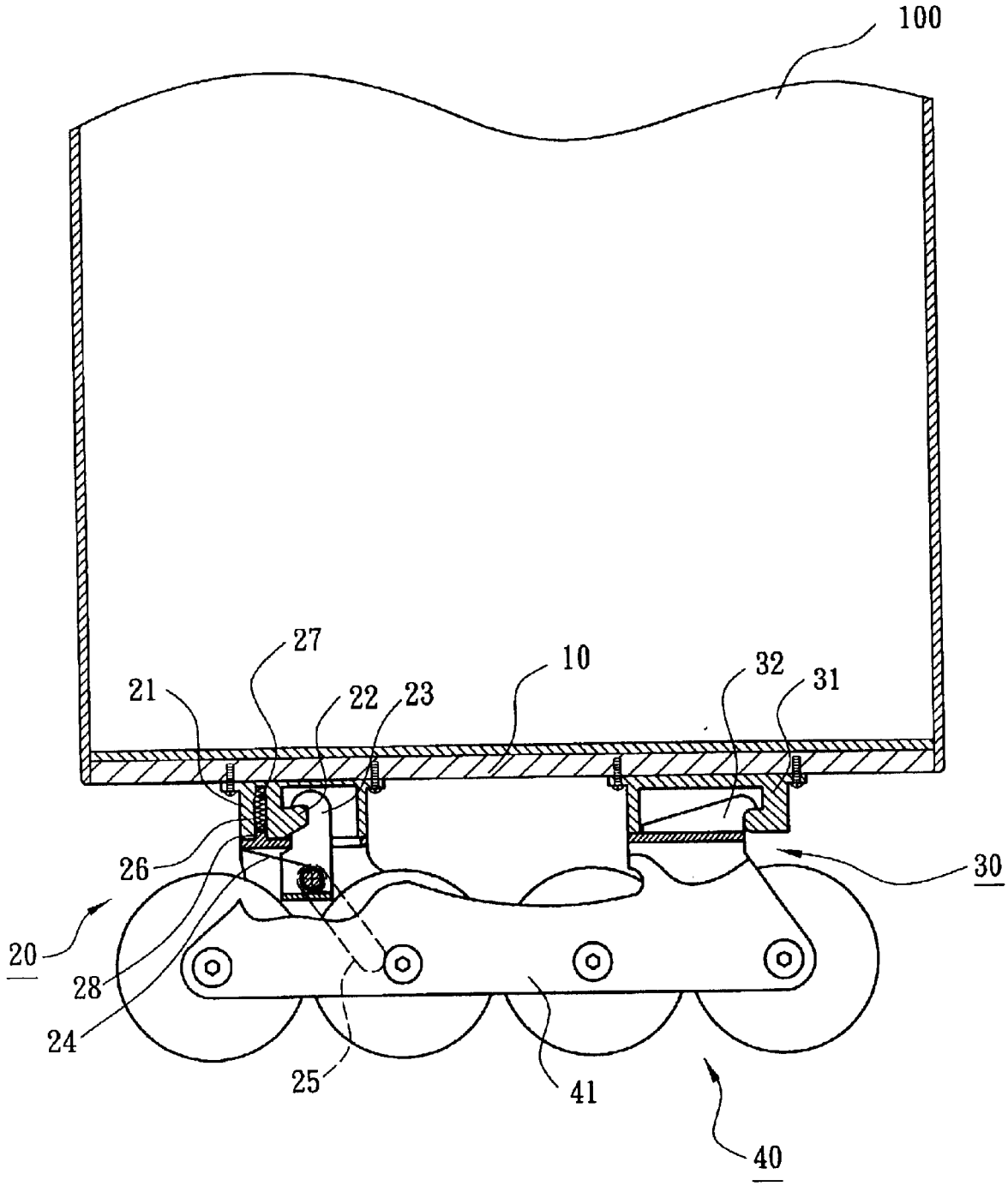
FIG. 6 is a partial cross-sectional view of the outer assembling mechanism of the backpack in accordance with a second embodiment of the present invention combined with the detachable skate.

Referring to FIG. 6, reference numerals of a second embodiment of the present invention have applied the identical numerals of the first embodiment. The backpack 100, the locking device 20, the pivotal device 30, and the detachable skate 40 of the second embodiment has the similar configuration and same function as the first embodiment and the detailed descriptions are omitted.

Referring again to FIG. 6, the base plate 10 is arranged at a bottom of the backpack 100. The locking seat 21 of the locking device 20 and the pivotal seat 31 of the pivotal device 30 are adapted to form assembling seats and securely fixed to the base plate 10 by screws.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. An outer assembling mechanism of a backpack for carrying a detachable skate, comprising:

a base plate provided with an underside;

a plurality of assembling seats provided on the underside of the base plate and adapted to assemble the detachable skate;

said assembling seats comprise a pivotal device adapted to pivotally connect to the detachable skate, and a locking device adapted to releasably lock the detachable skate; and wherein the assembling seats are adapted to releasably engage with the detachable skate for walking or to disengage with the detachable skate for skating.

2. The outer assembling mechanism as claimed in claim 1, wherein the base plate is provided with a plurality of cavities at the underside of the base plate.

3. The outer assembly mechanism as claimed in claim 2, wherein the cavities comprise a first cavity provided with the pivotal device of the assembling seats adapted to pivotally connect to a pivotal member of the detachable skate, and a second cavity provided with the locking device adapted to releasably lock the detachable skate.

4. The outer assembling mechanism as claimed in claim 3, wherein the pivotal device includes a pivotal seat fixed to the backpack and being adapted to pivotally connect to a pivotal hook provided on the detachable skate.

5. The outer assembling mechanism as claimed in claim 3, wherein the locking device comprises a locking seat with an engaging wall fixed to the backpack and being adapted to releasably engage with a rotatable hook provided on the detachable skate.

6. The outer assembling mechanism as claimed in claim 5, wherein the locking device further comprises a lever being used to rotate said rotatable hook for assembling or disassembling operation.

7. The outer assembling mechanism as claimed in claim 6, wherein the locking device further comprises a first elastic member provided to bias said rotatable hook and said lever is used to rotate said rotatable hook by means of overcoming bias force of said first elastic member.

8. The outer assembling mechanism as claimed in claim 6, wherein the locking device further comprises a guiding hole and a second elastic member received therein provided on said locking seat, and a guiding stud provided on the skate for being inserted into said guiding hole and biased by said second elastic member.

9. The outer assembling mechanism as claimed in claim 1, wherein the base plate is arranged at a bottom of the backpack.

10. The outer assembling mechanism as claimed in claim 1, wherein the assembling seats are securely fixed to the base plate by screws.

* * * * *